US007314022B2

(12) United States Patent
Sollaccio

(10) Patent No.: US 7,314,022 B2
(45) Date of Patent: Jan. 1, 2008

(54) MEDICINE BOTTLE CAP WITH TIME AND DAY MARKERS

(76) Inventor: Annabella S. Sollaccio, 136 Lupine Way, Stirling, NJ (US) 07980

( * ) Notice: Subject to any disclaimer, the term of this patent is extended or adjusted under 35 U.S.C. 154(b) by 0 days.

(21) Appl. No.: 11/223,288

(22) Filed: Sep. 9, 2005

(65) Prior Publication Data

US 2007/0056503 A1 Mar. 15, 2007

(51) Int. Cl.
*G09F 9/00* (2006.01)

(52) U.S. Cl. ..... 116/308; 116/309; 116/319; 206/459.1; 215/230

(58) Field of Classification Search ..... 116/308, 116/309, 306, 316, 318, 319, 284, 293, 298, 116/299, 320; 206/459.1; 215/230; 235/120, 235/43

See application file for complete search history.

(56) References Cited

U.S. PATENT DOCUMENTS

| | | | | | |
|---|---|---|---|---|---|
| 341,621 | A | * | 5/1886 | Zanetti | 116/308 |
| 535,610 | A | * | 3/1895 | Blaney | 116/308 |
| 596,646 | A | * | 1/1898 | Altshul | 215/365 |
| 623,171 | A | * | 4/1899 | Mowry | 116/308 |
| 1,211,737 | A | * | 1/1917 | Martini | |
| 1,237,700 | A | * | 8/1917 | Roberts | 215/386 |
| 1,582,589 | A | * | 4/1926 | Exline | 40/314 |
| 1,759,080 | A | * | 5/1930 | Youngblodt | 116/308 |
| 1,971,854 | A | * | 8/1934 | Gould | 40/107 |
| 2,111,637 | A | * | 3/1938 | Mehaffey | |
| 2,587,147 | A | * | 2/1952 | Guion et al. | 116/308 |
| 2,724,552 | A | * | 11/1955 | Sherwood | 235/78 R |
| 2,817,451 | A | * | 12/1957 | Giles et al. | 215/230 |
| 3,446,179 | A | * | 5/1969 | Bender | |
| 3,753,417 | A | * | 8/1973 | Garby | 116/308 |
| 3,911,856 | A | * | 10/1975 | Ewing | |
| 3,960,713 | A | * | 6/1976 | Carey | 206/534 |
| 4,041,628 | A | * | 8/1977 | Sasson | |
| 4,345,541 | A | * | 8/1982 | Villa-Real | |
| 4,347,804 | A | * | 9/1982 | Villa-Real | 116/308 |
| 4,365,722 | A | * | 12/1982 | Kramer | 215/220 |
| 4,705,182 | A | * | 11/1987 | Newel-Lewis | 215/230 |
| 4,913,083 | A | * | 4/1990 | Valvo | |
| 4,920,912 | A | * | 5/1990 | Kirkling | |
| 4,985,879 | A | * | 1/1991 | Owens | 368/89 |
| 5,271,353 | A | * | 12/1993 | Besthorne | 116/308 |
| 5,279,422 | A | * | 1/1994 | Adams | 206/534 |
| 5,358,117 | A | * | 10/1994 | Adams | 206/534 |
| 5,577,335 | A | * | 11/1996 | Tucker | |

(Continued)

*Primary Examiner*—Richard Smith
*Assistant Examiner*—Amy R. Cohen
(74) *Attorney, Agent, or Firm*—Doherty IP Law Group LLC

(57) ABSTRACT

A medicine bottle cap with time and day markers includes a main cap member, a first set of indicia, a second set of indicia, a central axle, a first arrow arm and a second arrow arm. The main cap member has a top and a circular sidewall that itself has an inside area with a bottle closure mechanism. Both sets of indicia are in a circular pattern located on the top of the cap. This first set of indicia is a fourteen position set of indicia, seven of which represent ante meridiem and each of the seven days of the week, and seven of which represent post meridiem and each of the seven days of the week. A central axle holds a rotatable first arrow arm that extends to the first set of indicia, and a second arrow arm that extends to the second set of indicia.

18 Claims, 4 Drawing Sheets

U.S. PATENT DOCUMENTS 5,694,882 A * 12/1997 Marshall
5,720,392 A * 2/1998 Price
5,984,122 A * 11/1999 Barker et al. ..... 215/230
6,068,149 A * 5/2000 Telega ..... 215/230
6,152,067 A * 11/2000 Mathison
7,032,535 B2 * 4/2006 Halstead et al. ..... 116/308
2006/0180566 A1 * 8/2006 Mataya ..... 215/230

* cited by examiner

MEDICINE BOTTLE CAP WITH TIME AND DAY MARKERS

BACKGROUND OF THE INVENTION

1. Field of the Invention

The present invention is directed to a medicine bottle cap with time and day markers. The cap may be child resistant or not child resistant, and it may be one that attaches to or is directly connected to a container, or it may be an overcap, either with a child resistant undercap arrangement or as a stand alone for retrofitting over existing caps. Uniquely, the present invention caps include a set of time and a set of day indicia wherein the day indicia is set up with fourteen separate sectors.

2. Information Disclosure Statement

The following prior art represents various types of medicine dosage reminder arrangements:

U.S. Pat. No. 6,152,067 describes a medication dosage reminder device that includes a cruciform hub that attaches to a medication container and an annular dial that is pinned between the hub and the container but is otherwise free to rotate about the hub. The dial includes time of day indicia and the hub includes a co-operating pointer for selecting the time of day so indicated. A patient can rotate the dial about the hub to indicate the time of which the last dose of medication was taken or the time at which the next dose of medication is due.

U.S. Pat. No. 5,720,392 describes a device for indicating when a person either took a pill or other medication, or when he is scheduled to take the next dose of the medication. The invention is conveniently attached to a pill bottle having a cap. An image of a clockface is printed on or adhered to the top of the bottle cap and/or the bottom and may include either a MEDICATION TAKEN AT image or a MEDICATION DUE AT image. A transparent, rotatable cap, having an arrow indicator inscribed thereon, is placed over the bottle cap. A second transparent, rotatable cup, having an arrow indicator inscribed thereon may be placed over a clock face image and a medication image on the bottom for use as a second timer reminder. When a medication is taken, the rotatable cover covering the MEDICATION TAKEN AT end is turned to the time taken. The opposite end timer is then turned to the MEDICATION DUE AT end to indicate when the next dose is due.

U.S. Pat. No. 5,694,882 describes indicators and methods of indicating. Intended primarily for use with medicine containers, the devices typically indicate the number of doses of medication ingested or remaining to be taken by a patient during a particular period. These devices additionally provide tactile assistance to patients in appropriately repositioning the indicator arms and, when used correctly, may reduce the possibility of patient overdose by restricting improper attempts to advance the indicator arm.

U.S. Pat. No. 5,577,335 describes a compliance system that helps patients organize and comprehend multiple or single medication and treatment schedules. Containers for prescribed and-over-the-counter drugs are numbered to coordinate with a numbered medication listing and medication profile. The numbered medication listing is made visible on an easel structure that also comprises large master dials whose faces have time or day indicia imprinted and an attached anchor on which a perforated pointer is seated to rotate relative to each other. Optional magnet master dials are provided for other visible places, such as the refrigerator door, to alert to schedule compliance time or day. The numbered containers are provided with small dials, imprinted with time or day indicia, that are perforated to seat on the adhesive anchor arrow indicator to rotate relative to each other. The dials are digitally advanced to the next treatment due time after each procedure is completed to reassure or remind of Schedule compliance and to avoid double dosing a medication. The simplified compliance system can help save time and phone calls in dispensing the required verbal and written drug information by providing a medication profile form and the organized teaching tools to help the patient comprehend the schedule and reinforce the verbal consultations with the system's medication profile.

U.S. Pat. No. 4,920,912 describes a time dial for a pharmaceutical container, preferably the container cap. The time dial comprises a disk rotatably mounted on the top surface of the cap; a window in the disk; and a plurality of numerals representing hours arranged in a ring on the top surface of the cap, underlying the disk, whereby rotation of the disk causes a select numeral to appear through the window.

U.S. Pat. No. 4,913,083 describes a method for reminding a person when to take medication. A series of indicia are put on a plurality of flat areas about the circumference of the safety cap, which are in line with the interior stops of the safety cap. The indicia corresponds to times medication is required to be taken. The safety cap is placed upon a safety bottle in such a manner that one of the flat areas line up with an indicator below one of the plurality of exterior stops on the safety bottle that engage with the interior stops of the safety cap so as to show a person the first time medication is to be taken. The safety cap is then removed from the safety bottle and then replaced back on the safety bottle in such a manner that each next in sequence of the flat areas line up with the indicator 22 so as to show the person each next time medication is to be taken.

U.S. Pat. No. 4,345,541 describes a simple mechanically manipulatable two-component inter-acting device for use as an effective medication-time-intake reminder having an attachable-detachable outer rotatory ring with either a singular or a plurality of outer protrusions for easy clockwise turning purposes in relation to a correspondingly engageable stationary component having a flat circularly running clock-like numeral indicia that are equally interspaced between each succeeding numerals ranging from 1 to 12 is disclosed. Each respective rotary ring has fixed clockwise spacing interval between the "LAST DOSE" arrow indicia and the "NEXT DOSE" arrow indicia depending upon the required application to accomplish the specific time interval in the administration of each corresponding particular medication. For functional effectively it is preferred that each kind of rotatory ring for each respective time-interval application be differentially color-coded to easily distinguish one from the others.

U.S. Pat. No. 4,041,628 describes an apparatus for visually registering information, which utilizes an outer adjustable member containing transparent indicia, which indicia will become visually distinct when said indicia is moved to overlie an inner fixed member and a color area thereon differing from the color surrounding said indicia.

U.S. Pat. No. 4,347,804 describes a simple mechanically manipulatable two-component interacting device for use as an effective medication time intake reminder having a stationary outer ring component having a circularly running clocklike numerical indicia that are equally interspaced between each succeeding numeral ranging from 1 to 12 is disclosed. The inner rotatory disc has fixed interval spacings between the "LAST DOSE" arrow indicia and the "NEXT DOSE" arrow indicia depending upon the required application such as the time interval called for in the administration of each particular medication. It is also disclosed and preferred that each rotatory disc for each respective time interval application be differently color coded to easily distinguish one from the other.

U.S. Pat. No. 3,911,856 describes a device for containing medication and for indicating the time when such medication should be taken. The device comprises a base having a plurality of compartments arranged in a circle, and a cover rotatably carried by the base and overlying the compartments. A circular wall defines the outer peripheral portions of the compartments and a circular ledge circumscribes the wall and has an upwardly facing saw-tooth edge. A screw-threaded hub extends upwardly from the center portion of the compartments. The cover is formed of a transparent material, such as clear plastic, and is in the form of a circular disc with a central opening to pass the threaded hub, and an off-center opening, which may be aligned with a selected compartment. The cover has a depending peripheral flange with a saw-tooth edge which is complementary to the edge of the circular ledge. An internally threaded cap is threaded on the hub to hold the cover in place and against unintentional rotation by reason of the fact that the complementary saw-tooth edges are held in mating relationship. All, or selected compartments, are filled with prescribed medicinal tablets and each compartment is marked with a prescribed indicia, such as certain hours of the day. At the prescribed time, the user will rotate the cap in a direction to permit the slight elevation of the cover to disengage the saw-tooth edges, whereby the cover may be rotated to align the cover opening with the desired compartment. The cap is then threaded to move the cover onto the compartments and to engage the saw-tooth edges, and the device may be inverted to remove the tablet from the compartment, through the opening in the cover.

U.S. Pat. No. 3,446,179 describes a cover for receptacles having an auxiliary pill-holding portion and a closure member to seal said pill-holding portion, said pill-receiving portion having time indicia inscribed thereon whereby indicating means carried by said closure member will coact with said time indicia to enable the user to record the time the next pill is to be taken, and orientation means provided whereby said closure member can be selectively seated within said pill-receiving portion to preclude accidental movement of said closure member once seated.

U.S. Pat. No. 2,111,637 describes new and useful improvements in bottle caps, especially of the kind used for medicine bottles, and the said caps have with this object in view been constructed with a recording dial and dose indicator.

U.S. Pat. No. 1,211,737 describes a device for indicating the particular times at which doses of medicine are to be taken. The object of this invention is to provide an inexpensive indicator, the operation of which is simple and self evident to persons called upon to use it and which is so constructed as to permit the same to be made inexpensively of sanitary material.

Notwithstanding the prior art, the present invention is neither taught nor rendered obvious thereby.

SUMMARY OF THE INVENTION

The present invention is a medicine bottle cap with time and day markers that uniquely utilizes a fourteen sector set of indicia to create a dual functionality capability for an arrow arm, coupled with a time set of indicia for a second arrow arm. This makes dosage regimen compliance easier and simpler for the patient. The present invention cap includes a main cap member, a first set of indicia, a second set of indicia, a central axle, a first arrow arm and a second arrow arm.

The main cap member has a top and a circular sidewall that itself has an inside area with a bottle closure mechanism. The first set of indicia is located on the top of the cap main member, and is positioned in a circular pattern on the top. This first set of indicia is a fourteen position set of indicia, seven of which represent ante meridian and each of the seven days of the week, and seven of which represent post meridiem and each of the seven days of the week. The second set of indicia is also located on the top and is a set of indicia representing twelve hours of a clock. It is positioned in a circular pattern, wherein the first set of indicia and the second set of indicia are concentric relative to one another.

There is also at least one central axle located in the center of the first set and second set of indicia. A first arrow arm is rotatably connected to the central axle and extends to the first set of indicia, and a second arrow arm is rotatably connected to the central axle and extends to the second set of indicia. Typically, the arrow arms are of different lengths, but could be the same length without exceeding the scope of the present invention.

The present invention medicine bottle cap has a bottle closure mechanism that is preferably selected from the group consisting of a screw cap mechanism, a snap cap mechanism and a flip cap mechanism, although any available closure mechanism could be used.

In some preferred embodiments, the present invention medicine bottle cap first set of indicia-includes letters representing seven days of the week and at least one letter representing one of ante meridian and post meridiem. In some preferred embodiments, the present invention ante meridian indicia is represented by the letters AM and the post meridiem is represented by the letters PM.

In some preferred embodiments, the present invention medicine bottle cap second set of indicia is selected from the group consisting of equally spaced marks, at least four numerals and combinations thereof.

In preferred embodiments, the second set of indicia is twelve evenly spaced numerals, twelve evenly spaced marks or four numerals with two marks between each of the numerals, e.g. "12", two evenly spaced bars, "3", two evenly spaced bars, "6", etc.

In some preferred embodiments, the present invention main cap member also includes at least one child resistant mechanism.

Preferably, the main cap member, and the first set of indicia and the second set of indicia are a single homogeneous structure, and each of the first set of indicia and second set of indicia have topography selected from the groups consisting of raised indicia, indented indicia and combination thereof. In some preferred embodiments, the present invention the main cap member and the at least one axle are a single homogeneous structure. In some preferred embodiments, the present invention, the main cap member, the first set of indicia, the second set of indicia and the at least one axle are a single homogeneous structure.

In some preferred embodiments, the present invention central axle has at least a lower section having a first diameter and an upper section having a second diameter, wherein the second diameter is less than the first diameter. Also, in some preferred embodiments, the present invention central axle has a top that includes a one-way lock that permits an arrow arm to slide onto the central axle in a downward direction and prohibits removal of the arrow arm from the central axle in an upward direction.

In addition to the present invent cap, the present inventions also includes an overcap alternative for retrofitting existing caps. This present invention overcap with time and day markers, includes:

a.) a main overcap member having a top and a circular sidewall, the sidewall having an inside area adapted to nest upon a cap, and having a cap attachment means adapted to attach the overcap to the cap;

b.) a first set of indicia located on the top, the first set of indicia being positioned in a circular pattern on the top and being a fourteen position set of indicia, seven of which represent ante meridian each of the seven days of the week, and seven of which represent post meridiem each of the seven days of the week;

c.) a second set of indicia located on the top and being a set of indicia representing twelve hours of a clock and being positioned in a circular pattern, whereas the first set of indicia and the second set of indicia are concentric relative to one another;

d.) at least one central axle located in a center of the first set and second set of indicia;

e.) a first arrow arm rotatably connected to the at least one central axle and extending to said first set of indicia; and f.) a second arrow arm rotatably connected to said at least one central axle and extending to the second set of indicia. The details for the top, the indicia, the arrow arms and the axle may be the same as those described above for the present invention cap.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
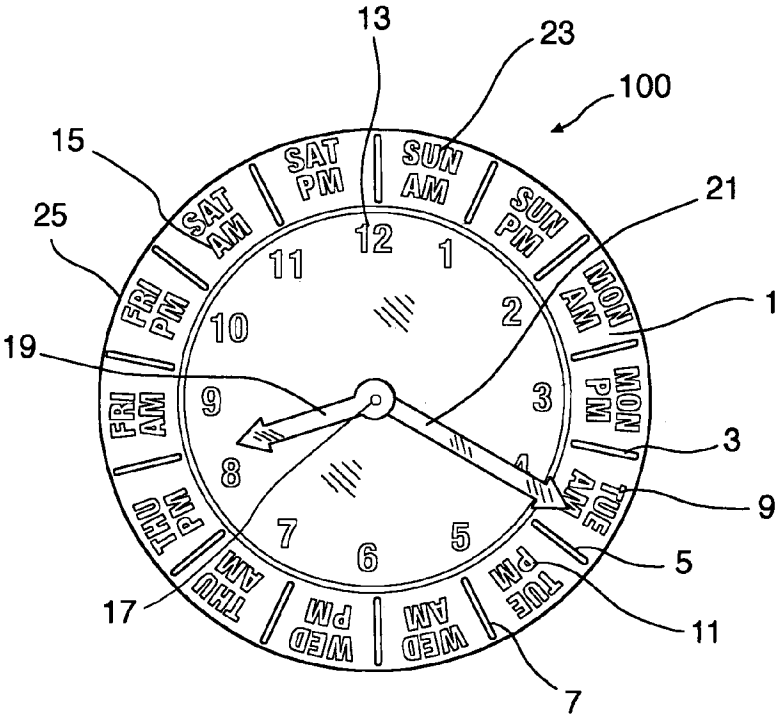
FIG. 1 illustrates a top view of a present invention medicine container cap with time and day markers.

Many individuals take prescription medication do not follow the dosage regimen and fail to cure or eliminate their illness or medical problem, overdose by taking too much medicine or are not sufficiently medicated because they fail to take the medication in a timely fashion. This is especially true of the elderly, who do not have the mental faculties of a normal person and are often forgetful. In addition, the timing of several different types of medications complicates the coordination of the various medications. The timing problem is especially acute in the case of home care. Each day a new nurse or attendant arrives, it is important for them to know when the last medication was taken or when the next dose is due. Clocks or other timing devices would not have the memory required to keep the exact times for medication. Furthermore, some elderly persons would not have the mental capacity nor skills required for setting sophisticated timing devices. Accordingly, it is an object of the invention to provide a directly readable device for indicating the time that medication is next due to be taken FIG. 1 illustrates a top view of a present invention medicine container cap 100, with time and day markers. Cap 100 includes a top 1 with a circular side wall 25 and a bottle closure mechanism, such as threading, located on an inside area (not shown) of side wall 25. There are 15 sectors dividing ridges, such as ridges 3, 5 and 7 to create an outer circle of 14 sectors, such as sector 9, which shows TUE and AM. Each sector of the 14 sectors has indicia for the day of the week, such as indicia 23 and indicia for ante meridem or post meridem, such as indicia 15. Thus, 7 of these sectors each have a day of the week with a morning indicia and 7 more of these sectors repeat the day of the week but include a post-noon indicia. Thus, the present invention cap includes a circular pattern that has a 14 position set of indicia. With this arrangement, moveable arrow arm 21 may be rotated to an outer circle sector to simultaneously select both a day of the week and morning or afternoon with a single arrow arm. The ridges 3, 5 and 7 act as placement ridges that keep arrow arm 21 in its selected position. In other words, there arrow arm must be pushed over the ridges to be relocated. Alternatively, ratchets could be attached at central axle 17 on the arrow arms to create sufficient friction to hold them in there selected positions.

An inner circle or circular pattern of time indicia are also presented on top 1. These time indicia may be any indicia that connote time. They could be marks, such as 12 evenly spaced lines or dots, Arabic numerals, Roman numerals or any other No. designator. Thus, indicia 13 represents twelve o'clock and arrow arm 19, also located on axle 17, may be moved to a desired time, such as 8:30 as shown in the Figure.

A user taking medication may be required to take the medication 1, 2 or 3 times a day and each time the medication is taken one could reset the arrow arms 19 and 21 to the next required time to take the medication.

Figure 2:
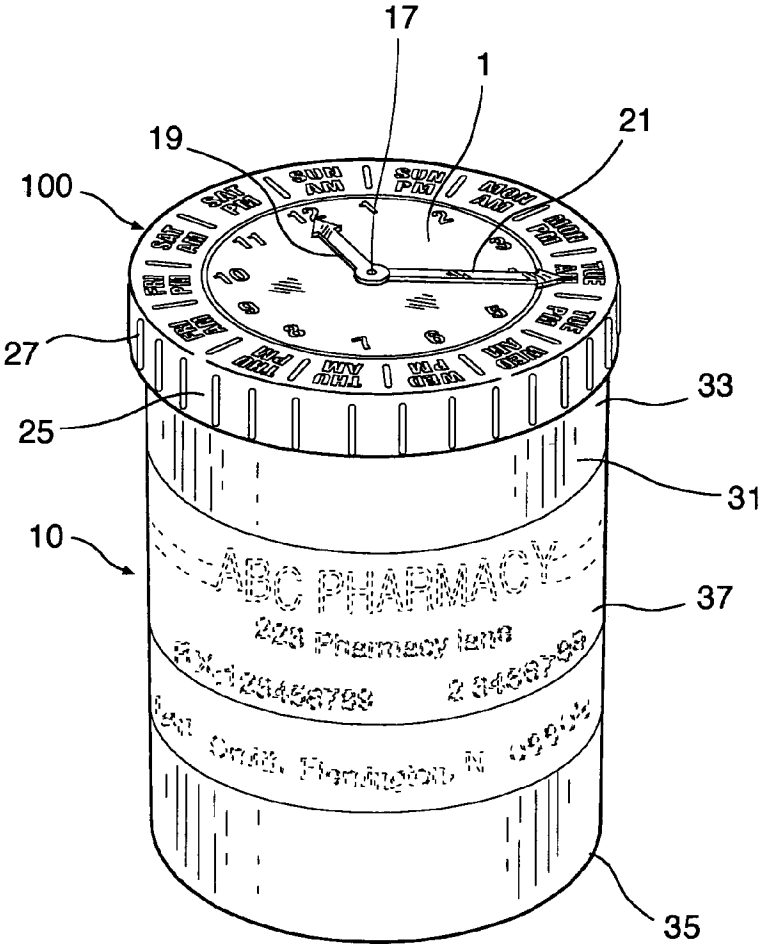
FIG. 2 shows an oblique view of the present invention cap of FIG. 1 and a medicine bottle to which it is attached.

FIG. 2 shows an oblique view of the present invention cap 100 of FIG. 1 and a medicine bottle 10 to which it is attached. Components already sown in FIG. 1 are partially renumbered merely for reference. Cap 100 has ridges 27 on side wall 25 to facilitate griping and opening and closing of the cap to the bottle 10. Bottle 10 has a cylindrical side wall 31 and operates with a threaded top or snap bead top 33, or equivalent, in a conventional fashion. Its bottom 35 is flat for resting on a shelf, sink, burro or otherwise, wherein the top 1 is clearly visible to the user as a reminder and a guide.

Prescription label 37 will set forth the regimen for dosage quantity and frequency, and that information will be used by the patient to set the present invention reminder cap for each next required dosage.

While the above examples show the outer circular pattern as having the day and meridiem indicia, and the inner circular pattern as having the time indicia, these could be reversed without exceeding the scope of present invention. In other words, the time indicia could be in the outer circle and the day and meridiem indicia could be in the inner circle.

Figure 3:
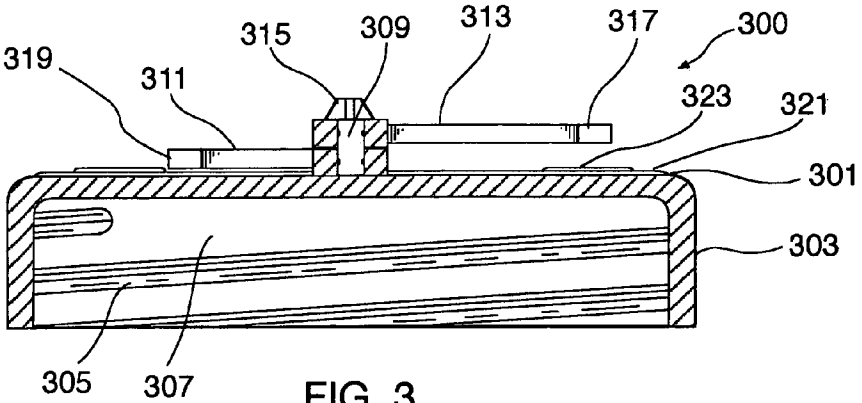
FIG. 3 shows a side, cut view of a present invention cap.

FIG. 3 shows a side, cut view of another present invention cap 300. It has a top 301 and a circular side wall 303. Inside wall 307 has threads 305 for attachment to a container. Top 301 includes a raised molded disk 321 with raised indicia, such as indicia 323, to create a top representation similar to FIG. 1 above or FIG. 7 or FIG. 9 below. Central axle 309 has a collapsible fan top 315 that yields to the arrow arms being pushed downwardly thereon and resists removal of same therefrom. Lower arrow arm 311 with arrow head 319 and upper arrow arm 313 with arrow head 317 are independently rotatable to permit a user to set day/meridiem and time reminder positions for taking medication.

Figure 4:
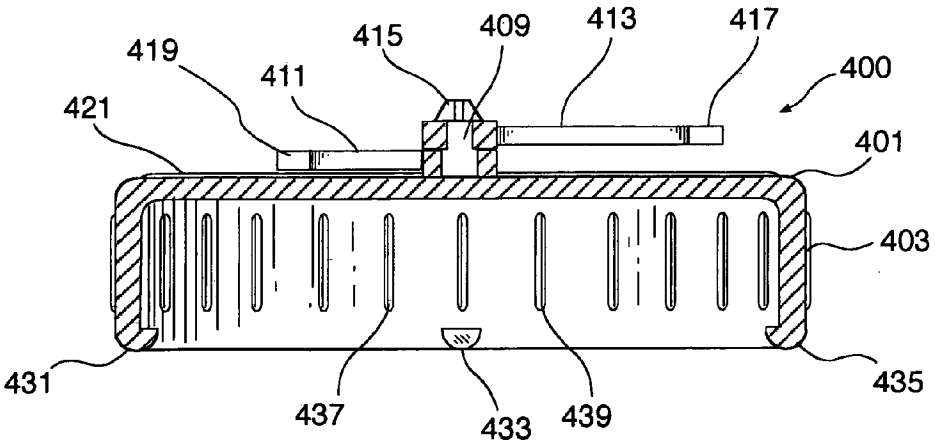
FIG. 4 shows a side, cut view of a present invention overcap for attachment to and nesting on an existing cap to act as a retrofit product.

FIG. 4 shows a side, cut view of a present invention overcap 400 for attachment to and nesting on an existing cap to act as a retrofit product. It has a top 401 and a circular side wall 403. Inside wall 403 is a series of vertical ratchets or ridges, such as ridges 437 and 439, for catching outside ridges on a conventiontional cap to which this is overfitted to enhance ease of opening and closing. It also has locking tabs, such as tabs 431, 433 and 435 to prevent separation once overcap 400 has been retrofitted to an existing cap. Top 401 includes a raised molded disk 421 with raised indicia, such as indicia 323, and impressed indicatia (below vision level in this view) to create a top representation of the present invention sets of indicia similar to those shown in FIG. 1 above or FIG. 7 or FIG. 9 below. Central axle 409 has a two diameter shaft area and a fold-in top 415 that yields to the arrow arms being pushed downwardly thereon and resists removal of same therefrom. Lower arrow arm 411 with arrow head 419 and upper arrow arm 413 with arrow head 417 are independently rotatable to permit a user, a nurse, a pharmacist or other person to set day/meridiem and time reminder positions for taking medication.

Figure 5:
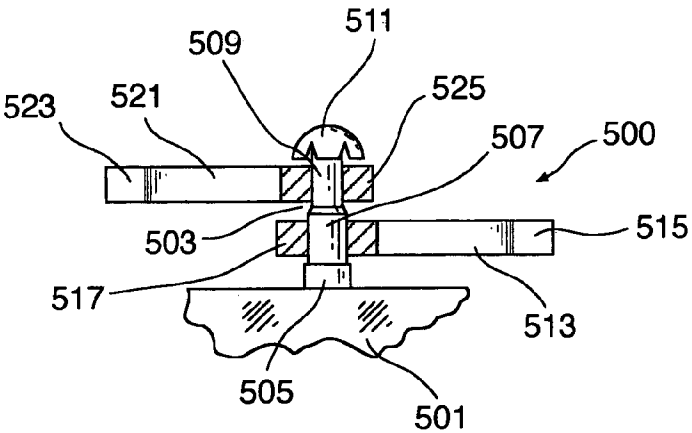
FIG. 5 illustrates a partial, cut side view of a present invention cap emphasizing the axle and arm attachment arrangements.

FIG. 5 illustrates a partial, cut side view of a present invention cap 500, emphasizing the axle 503 with holding top 511, and arrow arm attachment arrangements. Specifically, axle 503 is uninstructurally formed with cap top 501 in a single mold, as may be all of the indicia and sector separator indicia, e.g., everything sown on the top of cap 100 in FIG. 1, except for the two rotatable arrow arms. In this FIG. 5, axle 503 has a wide diameter shaft base 505 and a midsized center shaft area 507, so that the orifice-containing segment 517 of arrow arm 513 rests on base 505 and fits around area 507. Likewise, upper shaft area 509 is narrower in diameter that area 507, and top arrow arm 521 orifice-containing segment 525 sits on top of area 505 and around area 509. By this arrangement, the individual arrow arms 513 and 521, with their respective arrow heads 515 and 523 for pointing to selected indicia, never touch each other or drag on each other, providing independent and noninterferring movement of each.

Figure 6:
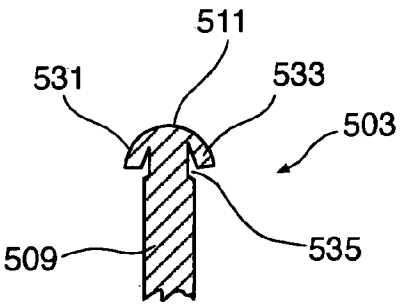
FIG. 6 shows a side cut view of more details of the axle shown in FIG. 5.

FIG. 6 shows a side cut view of more details of the axle 503 shown in FIG. 5. Here, in this partial, cut view, the top 511 has one way ears, such as flaps 531 and 533, that will fold into the recess area 535 when an arrow arm is pushed down over it, but will not fold and resist upward movement of an attached arm to prevent removal.

Figure 7:
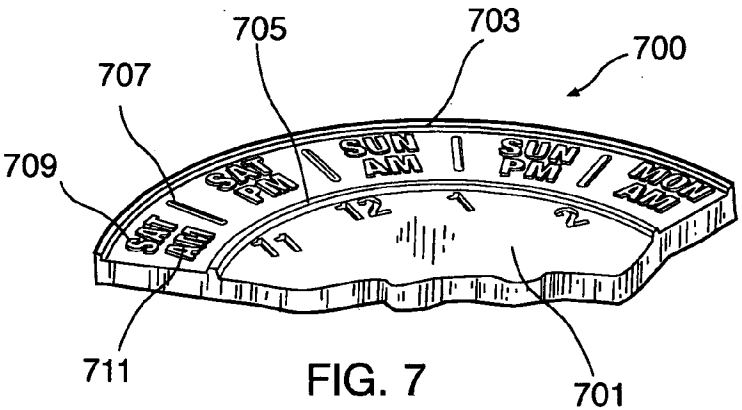
FIG. 7 illustrates a partial oblique view of a present invention cap showing the indicia and dividers in raised and/or cut relief.

FIG. 7 illustrates a partial oblique view of a present invention cap 700, showing the indicia such as indicia 709 and 711 and dividers such as divider 707, and outer edge 703, molded in a raised position. Note that the inner circle 705 is pressed into top 701. This shows that any or all of the indicia, dividers, other markings and borders may be indented or raised or any combination thereof.

Figure 8:
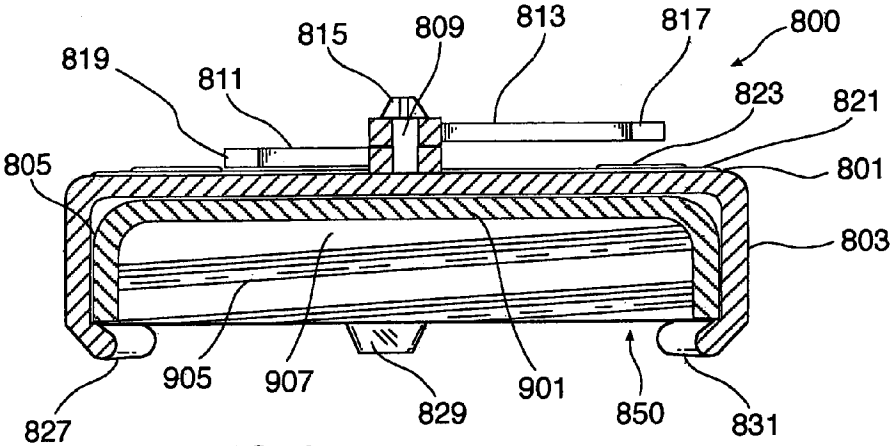
FIG. 8 shows a child resistant safety cap version of the present invention cap wherein it includes a slip/squeeze-to-grip outer cap/inner cap arrangement; and, FIG. 9 shows a front view of an alternative embodiment present invention cap top.

FIG. 8 shows a child resistant safety cap version of the present invention cap 800 wherein it includes a slip/squeeze-to-grip outer cap/inner cap arrangement. Cap 800 has a top 801 and a circular side wall 803. Inside wall 307 has griping ridges or equivalent inner cap engagement mechanisms 805, similar to the overcap ridge 437 of FIG. 4 described above. Cap top 801 includes a raised molded disk 821 with raised indicia, such as indicia 823, to create a top representation similar to FIG. 1 above or FIG. 7 or FIG. 9 below. Central axle 809 has a collapsible top section 815 similar to those described, and yields to the arrow arms being pushed downwardly thereon and resists removal of same therefrom. Lower arrow arm 811 with arrow head 819 and upper arrow arm 813 with arrow head 817 are independently rotatable to permit a user to set day/meridiem and time reminder positions for taking medication. Inner cap 850 floats freely inside cap 800, but cannot be removed due to stops 827, 829 and 831. Inner cap 850 has internal threads 905 on its inside wall 907 for engagement with a bottle ("bottle" as used herein throughout this application means any type of container, such as a cylindrical container, a vial, a tube, or other medicine holding container, without exceeding the scope of the present invention). The present invention outer cap 800 needs to be squeezed to engage with inner cap 850 for screwing onto and off a bottle and otherwise the inner cap 850 cannot be moved, rending this arrangement child-resistant.

Figure 9:
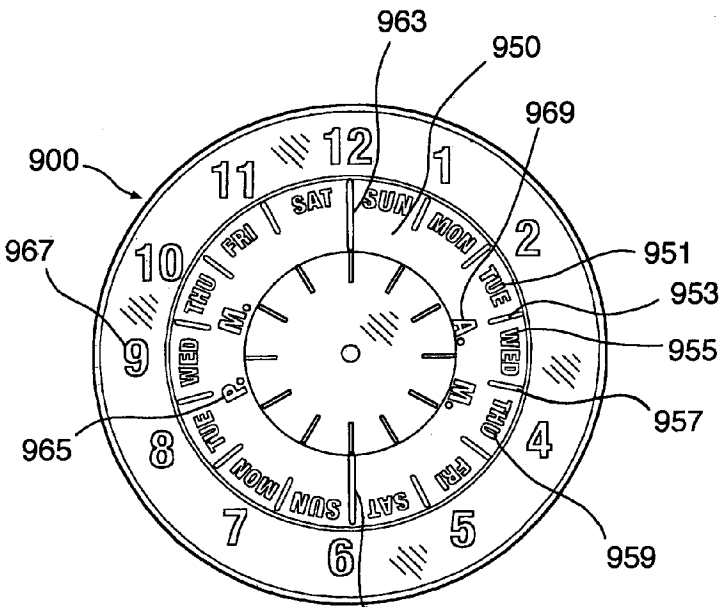

FIG. 9 shows a front view of an alternative embodiment present invention cap 900. It includes top 950 with fourteen weekday indicia such as days 951, 955 and 959. Sector dividers for the days of the week are also included, such as sectors 953 and 957. The days of the week appear twice, once for morning once for afternoon. Hence, there are two major dividers 961 and 963, to create two half circles, 14 ante meridiem and one for post meridiem. Ante meridiem indicia 969 and post meridiem indicia 965 are shown within the half circles. In this embodiment, twelve evenly spaced time numerals, such as numeral 967, are presented in an outer circle with a second set of time indicia (twelve line marks) being positioned centermost.

Obviously, numerous modifications and variations of the present invention are possible in light of the above teachings. It is therefore understood that within the scope of the appended claims, the invention may be practiced otherwise than as specifically described herein.

What is claimed is:

1. A medicine bottle cap with time and day markers, which comprises:

a.) a main cap member having a top and a circular sidewall, said sidewall having an inside area with a bottle closure mechanism, wherein said bottle closure mechanism is selected from the group consisting of a screw cap mechanism, a snap cap mechanism and a flip cap mechanism;

b.) a first set of indicia located on said top, said first set of indicia being positioned in a circular pattern on said top and being a fourteen position set of indicia, seven of which represent ante meridiem and each of the seven days of the week, and seven of which represent post meridiem and each of the seven days of the week;

c.) a second set of indicia located on said top and being a set of indicia representing twelve hours of a clock and being positioned in a circular pattern, wherein said first set of indicia and said second set of indicia are concentric relative to one another;

d.) a central axle located in a center of said first set and second set of indicia, wherein said central axle has a lower section adjacent said top having a first diameter and an upper section spaced from said top having a second diameter that is smaller than said first diameter;

e.) a first arrow arm rotatably connected to said central axle and extending to said first set of indicia; and f.) a second arrow arm rotatably connected to said central axle and extending to said second set of indicia, wherein one of said arrow arms is rotatably connected to the lower section of said central axle and the other one of said arrow arms is rotatably connected to the upper section of said central axle so as to provide noninterfering movement of said arrow arms g.) wherein said central axle has a top that includes a one-way lock having a collapsible fan top that permits said arrow arms to slide onto said central axle in a downward direction and prohibits removal of said arrow arms from said central axle in an upward direction.

2. The medicine bottle cap with time and day markers of claim 1 wherein said main cap member, and, said first set of indicia and said second set of indicia are a single homogeneous structure, and each of said first set of indicia and second set of indicia have topography selected from the group consisting of raised indicia, indented indicia and combinations thereof.

3. The medicine bottle cap with time and day markers of claim 2 wherein each of said first set of indicia includes letters representing seven days of the week and at least one letter representing one of ante meridiem and post meridiem.

4. The medicine bottle cap with time and day markers of claim 3 wherein ante meridiem is represented by the letters AM and post meridiem is represented by the letters PM.

5. The medicine bottle cap with time and day markers of claim 2 wherein said second set of indicia is selected from the group consisting of equally spaced marks, at least four numerals and combinations thereof.

6. The medicine bottle cap with time and day markers of claim 1 wherein said second set of indicia is twelve evenly spaced numerals.

7. The medicine bottle cap with time and day markers of claim 1 wherein said main cap member also includes at least one child resistant mechanism.

8. The medicine bottle cap with time and day markers of claim 1 wherein said main cap member and said central axle are a single homogeneous structure.

9. The medicine bottle cap with time and day markers of claim 1 wherein said main cap member, said first set of indicia, said second set of indicia and said central axle are a single homogenous structure.

10. The medicine bottle cap with time and day markers of claim 1 wherein said first arrow arm is rotatably connected to the lower section of said central axle and said second arrow arm is rotatably connected to the upper section of said central axle.

11. A medicine bottle overcap with time and day markers, which comprises:

a.) a main overcap member having a top and a circular sidewall,said sidewall having an inside area adapted to nest upon a cap with a bottle closure mechanism, wherein said bottle closure mechanism is selected from the group consisting of a screw cap mechanism, a snap cap mechanism and a flip cap mechanism, and having a cap attachment means adapted to attach said overcap to said cap;

b.) said main overcap member comprising a first set of indicia and a second set of indicia located on said top, wherein said first set of indicia consisting of a first set of indicia being positioned in a circular pattern on said top and being a fourteen position set Qf indicia, seven of which represent ante meridiem and each of the seven days of the week, and seven of which represent post meridiem and each of the seven days of the week;

c.) wherein said second set of indicia consisting of a set of indicia representing twelve hours of a clock and being positioned in a circular pattern, wherein said first set of indicia and said second set of indicia are concentric relative to one another, and wherein said first set of indicia and said second set of indicia are not located on said sidewall of said main overcap member;

d.) a central axle located in a center of said first set and second set of indicia;

e.) a first arrow arm rotatably connected to said central axle and extending to said first set of indicia; and f.) a second arrow arm rotatably connected to said central axle and extending to said second set of indicia;

g.) wherein said central axle has a top that includes a one-way lock having a collapsible fan top that permits said arrow arms to slide onto said central axle in a downward direction and prohibits removal of said arrow arms from said central axle in an upward direction.

12. The medicine bottle cap with time and day markers of claim 11 wherein said main cap member, said first set of indicia, said second set of indicia and said central axle are a single homogeneous structure.

13. The medicine bottle overcap with time and day markers of claim 11 wherein each of said first set of indicia includes letters representing one of the seven days of the week and at least one letter representing one of ante meridian and postmeridian.

14. The medicine bottle overcap with time and day markers of claim 11 wherein said second set of indicia are twelve evenly spaced numerals.

15. The medicine bottle overcap with time and day markers of claim 11 wherein said main cap member also includes at least one child resistant mechanism.

16. The medicine bottle overcap with time and day markers of claim 11 wherein said main cap member, and said first set of indicia and said second set of indicia are a single homogeneous structure, and each of said first set of indicia and second set of indicia have topography selected from the groups consisting of raised indicia, indented indicia and combinations thereof.

17. The medicine bottle overcap with time and day markers of claim 11 wherein said central axle has a lower section adjacent the top having a first diameter and an upper section spaced from the top having a second diameter, wherein said second diameter is smaller than said first diameter, and wherein one of said arrow arms is rotatably connected to the lower section of said central axle and the other one of said arrow arms is rotatably connected to the upper section of said central axle so as to provide independent and noninterfering movement of said arrow arms.

18. The medicine bottle overcap with time and day markers of claim 17, wherein said first arrow arm is rotatably connected with the lower section of said central axle and said second arrow arm is rotatably connected with the upper section of said central axle.

* * * * *